US007823724B2

(12) United States Patent
Mowe et al.

(10) Patent No.: US 7,823,724 B2
(45) Date of Patent: Nov. 2, 2010

(54) PAINT ROLLER SLEEVE STORAGE CONTAINER

(76) Inventors: William B. Mowe, 842 Maxic La., Lawrenceville, GA (US) 30044; Kelly L. Mowe, 842 Maxic La., Lawrenceville, GA (US) 30044

( * ) Notice: Subject to any disclaimer, the term of this patent is extended or adjusted under 35 U.S.C. 154(b) by 0 days.

(21) Appl. No.: 12/456,454

(22) Filed: Jun. 17, 2009

(65) Prior Publication Data

US 2009/0255837 A1 Oct. 15, 2009

Related U.S. Application Data

(63) Continuation-in-part of application No. 11/472,092, filed on Jun. 21, 2006, now abandoned.

(60) Provisional application No. 61/203,622, filed on Dec. 24, 2008.

(51) Int. Cl.
*B65D 85/00* (2006.01)
*B65D 53/00* (2006.01)

(52) U.S. Cl. ..... 206/361; 206/15.3; 206/362.3; 220/666; 220/375

(58) Field of Classification Search ..... 206/361, 206/15.2, 15.3, 362.2, 362.3; 15/248.2, 257.06; 220/375, 666
See application file for complete search history.

(56) References Cited

U.S. PATENT DOCUMENTS 3,623,179 A * 11/1971 Roth ..... 206/361
4,738,358 A * 4/1988 Kehl ..... 206/361
5,709,301 A * 1/1998 Couch et al. ..... 206/361

* cited by examiner

*Primary Examiner*—J. Gregory Pickett
(74) *Attorney, Agent, or Firm*—Richard B. Klar, Esq.; Law Office Richard B. Klar

(57) ABSTRACT

A storage container for paint roller sleeve includes a set of flutes on at least two opposing sides of an interior surface of said cylinder for stabilizing a roller cover in place from rattling inside of the housing and for holding said roller cover in place when extracting a roller frame from said roller cover. Each set of flutes includes three interior flutes that located between said two exterior flutes. The interior flutes include a middle flute that is set back a distance from the other two interior flutes so that when the exterior surface of the container is pressed inward said middle interior flute cuts into a paint roller sleeve housed within the container and the other two interior flutes bend outward around a nap of said roller sleeve to better hold said roller sleeve in place when a roller frame is being extracted from said roller sleeve.

9 Claims, 5 Drawing Sheets

PAINT ROLLER SLEEVE STORAGE CONTAINER

RELATED APPLICATIONS

This non-provisional application is a Continuation-in-Part of U.S. application Ser. No. 11/472,092 by Mowe, et al. filed Jun. 21, 2006 (abandoned) and provisional application Ser. No. 61/203,622 by Mowe, et al. filed Dec. 24, 2008.

BACKGROUND OF THE INVENTION

During a standard workday a painter may use one or more paint roller sleeves. Further, in many jobs more than one coat of paint is required. Moreover, if the job is not finished prior to a lunch break or at the end of the Workday, the sleeve must be cleaned or discarded. There is a need for a device in which a freshly used, yet to be cleaned paint roller sleeve can be stored overnight, ready for reuse the next day.

SUMMARY OF THE INVENTION

The object of this invention is to provide a container for a just used paint roller sleeve in which it can be stored and kept in such a condition that be used again immediately, for the same color paint, without first being cleaned. An additional object of this invention is to provide means for removing a wet paint sleeve from the roller without the painter's hand, whether gloved or otherwise, coming into direct contact with the sleeve.

In accordance with the present invention, there is provided an improved storage container which comprises a generally cylindrical tubular structure having a thin wall made of a flexible, resilient plastic and at least one pleated wall section joined thereto. Formed of a hinged-type plastic, the pleated wall section can be pressed inwardly by hand. When the pleated wall section is so pressed, teeth-like projections on its inside surface are brought into contact with any paint roller sleeve housed temporarily within the storage container and can be used to grip the sleeve firmly.

Means for keeping the paint roller sleeve from resting on the bottom surface of the container preferably includes a standoff. The height of the standoff determines the depth of the reservoir defined by the container for receiving excess paint, which drains from the sleeve during storage.

The upper portion of the tubular structure terminates upwardly in an opening for receiving the sleeve and preferably tapers outwardly. forming a funnel to facilitate insertion of the sleeve into the container and to capture any paint dripping from the sleeve which might otherwise drip outside the container during the insertion process.

Longitudinal ribs which extend inwardly from the inner walls of the tubular structure help to center the sleeve within the container and keep the sleeve, regardless of thickness of its nap from rattling around in the container The ribs are rounded off at proximate with the opening in the tubular structure so as to help guide the sleeve into the container.

In a typical use, the just used sleeve while still on the roller is inserted into the storage container. Next the user grasps the sides of the container and presses the pleated wall section inwardly, in such a way that its teeth-like projections engage the roller with sufficient force to hold it while the roller is being slipped out of the sleeve. The container is then closed with a snap-on cap or the like forming an airtight closure which keeps the paint from drying on the sleeve, even after a long storage. To reuse the sleeve, the cap is removed; and the roller is inserted into the sleeve. The user is ready to proceed with the paint work.

The cap is preferably attached to the outer walls of the container by a strap which has sufficient length that when the cap is in the closed position, a loop is formed in the strap that can be used for hanging the storage container.

Further, there is provided a section on the outer walls of the container for identification of the paint residual on the sleeve stored there within.

It is further desired to provide an embodiment in which the container has flutes that serve to center the roller within the container and in which the flutes have angled top and bottom surfaces with ends that when the container is pressed inward serve to cut into the sleeve of the roller and hold it in place when removing the handle.

PREFERRED DETAILED DESCRIPTION OF THE PREFERRED EMBODIMENTS

Figure 1:
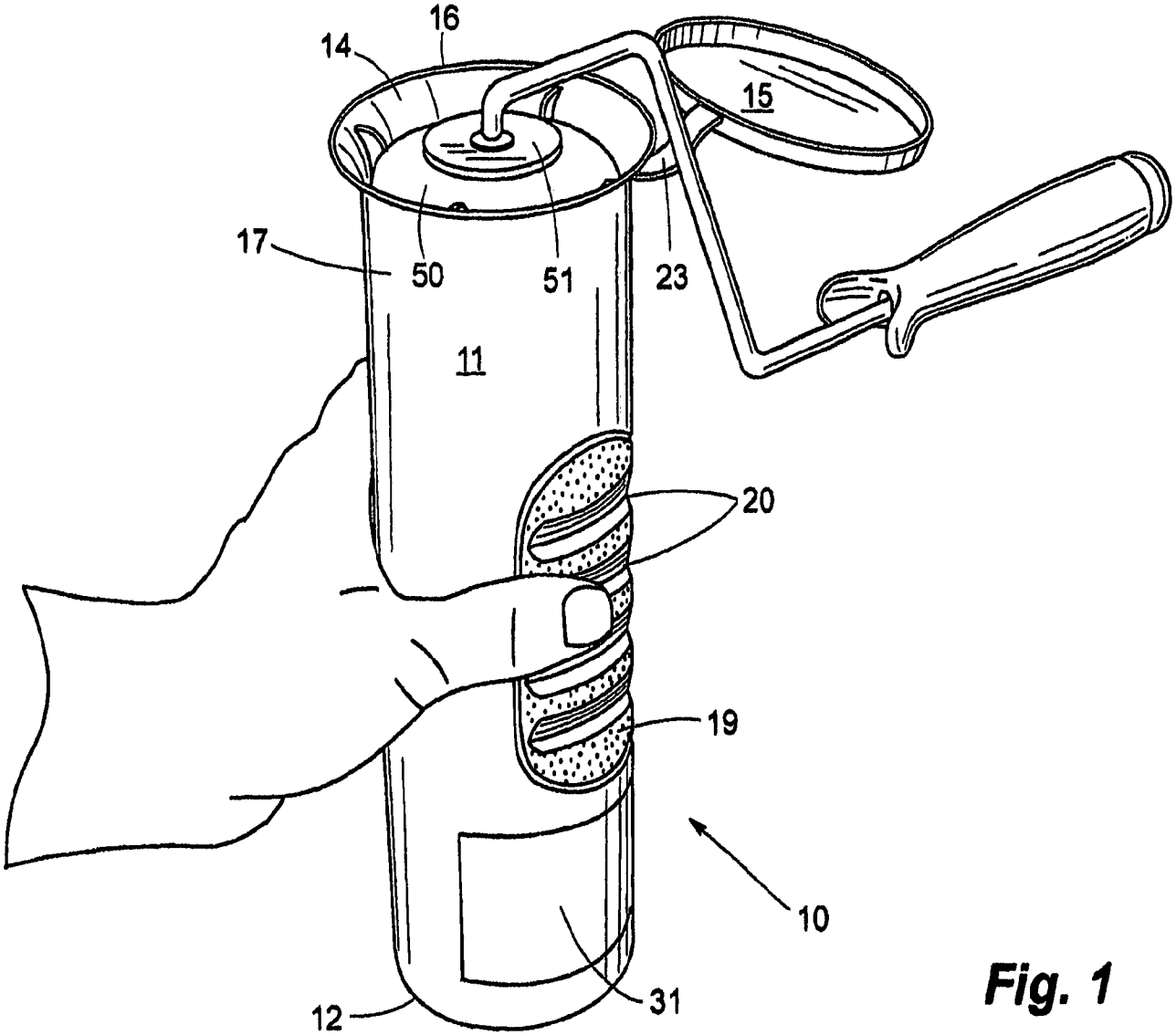
FIG. 1 is a perspective view of a paint roller sleeve storage container according to a first embodiment of the present invention, the storage container being shown holding a paint roller sleeve still mounted on its roller.

Referring to the drawings, a storage container 10 for a paint roller sleeve 50 includes a flexible, resilient, generally cylindrical housing 11 for removably storing the sleeve 50 therein. Sealed on its lower end 12, the housing 11 defines an upper opening 13, which is surrounded by a rim 16 atop sidewall 14. Terminating with the rim 16, the sidewall 14 tapers outwardly to form a funnel that aids in the insertion of the sleeve 50 while it is mounted on the paint roller 51 and keeps paint from dripping outside the container 10.

In the preferred embodiment, a cap 15 snap-fits on the rim 16 to provide an airtight seal. Attached to the cap 15 and to the housing 11 is a strap 23. When the container 10 is closed, the cap-retaining strap 23 is long enough to form a loop that can be used for hanging the container 10 on a pegboard or equivalent for display (FIGS. 2 and 3).

Figure 2:
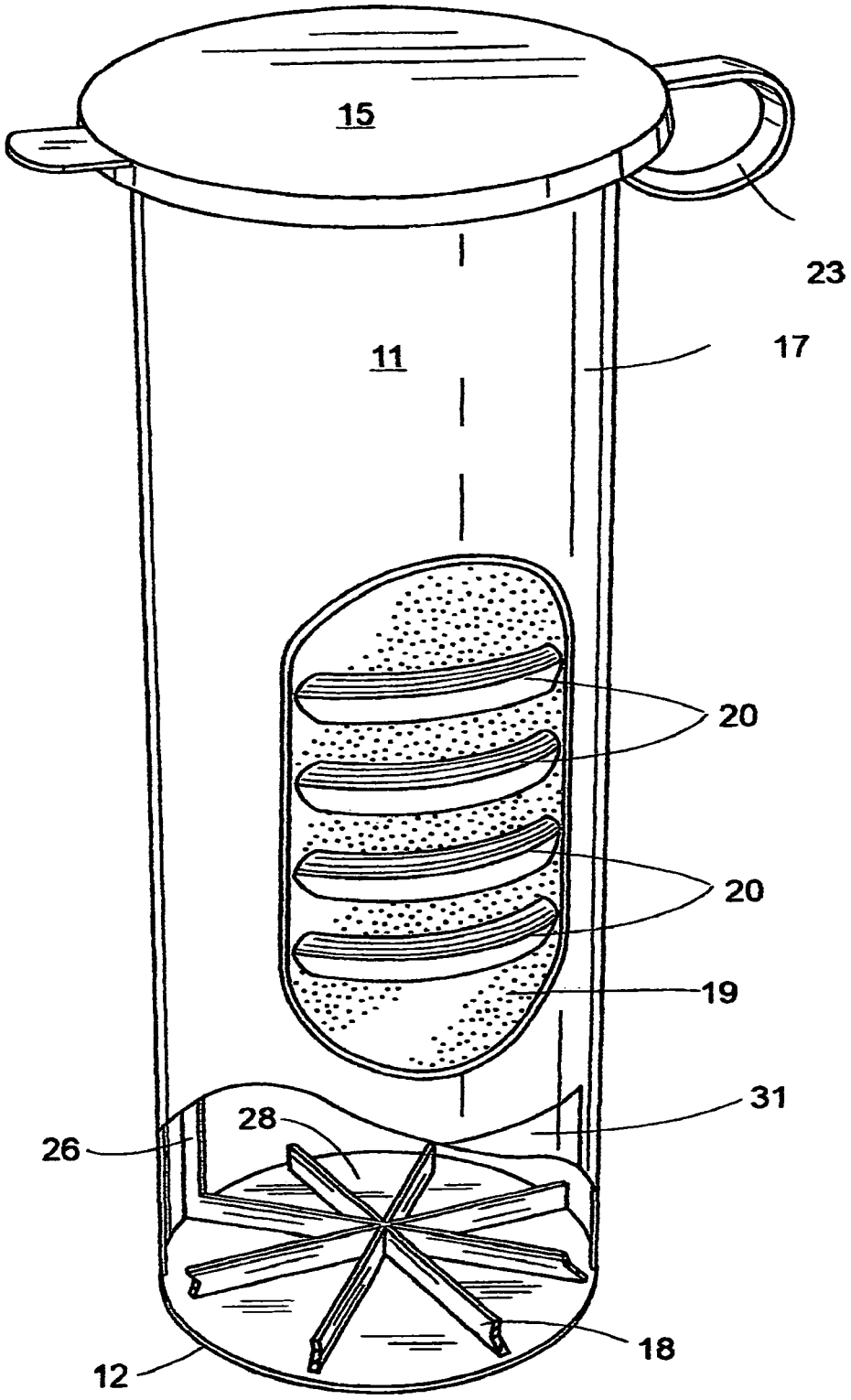
FIG. 2 is a perspective view, on an enlarged scale, of a fragmentary portion of the storage container according to FIG. 1. the storage container being shown empty with its snap-on cap in the closed position; a breakaway section in the lower end of the storage container revealing a standoff disposed therein.

As illustrated in FIG. 2, the container 10 preferably includes a standoff 18 disposed within the housing 11 proximate with its lower end 12. Formed in the shape of a star or similar structure, the standoff 18 keeps the sleeve 50 from resting on the bottom 12 of the container 10 and defines at least one pocket 28. The pocket 28 fluidly communicates with a reservoir defined by the lower end 12 for capturing any excess paint which drains from the sleeve 50 during storage.

Near the mid-section of the housing 11, at least one pleated wall section 19 made from a hinge-type plastic includes an array of ridges and grooves 20. In the preferred embodiment, two pleated wall sections 19 are disposed on opposing sides of the housing 11 (FIGS. 1-3). The ridges and grooves 20 move inwardly when the opposing wall. Sections 19 are gripped by the user and squeezed together firmly, Together the ridges and grooves 20 form a series of teeth-like projections 21 which hold the sleeve 50 in place while the sleeve is being stripped off of the roller 51. In use, a painter simply holds the handle of the roller 51 with one hand and while gripping the wall sections 19 so as to press them against the sleeve as it is being held within the container 10, pulls the sleeve off of the roller. Thus the sleeve 50, once inserted into the container 10, can be removed from the roller 51 without soiling the painter's hands.

Figure 3:
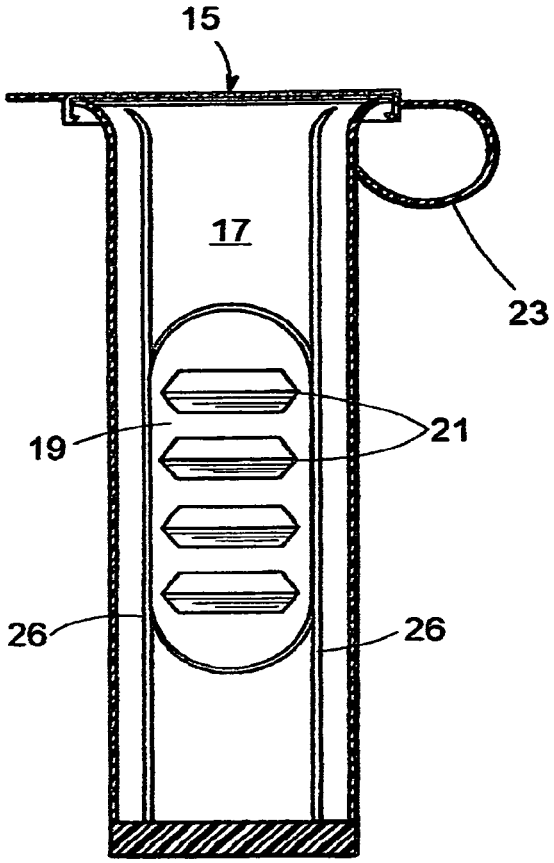
FIG. 3 is a cross-sectional view taken along line 3-3 of FIG. 4.
Figure 4A:
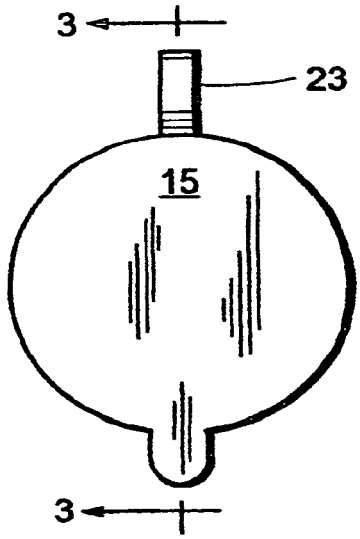
FIGS. 4A and 4B are top plan views of the storage container according to FIG. 1 with its snap-on cap in the closed and open positions, respectively.
Figure 4B:
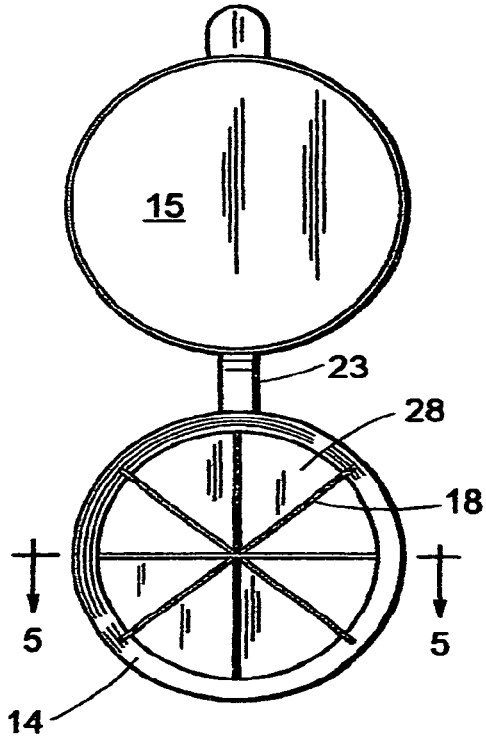
Figure 5:
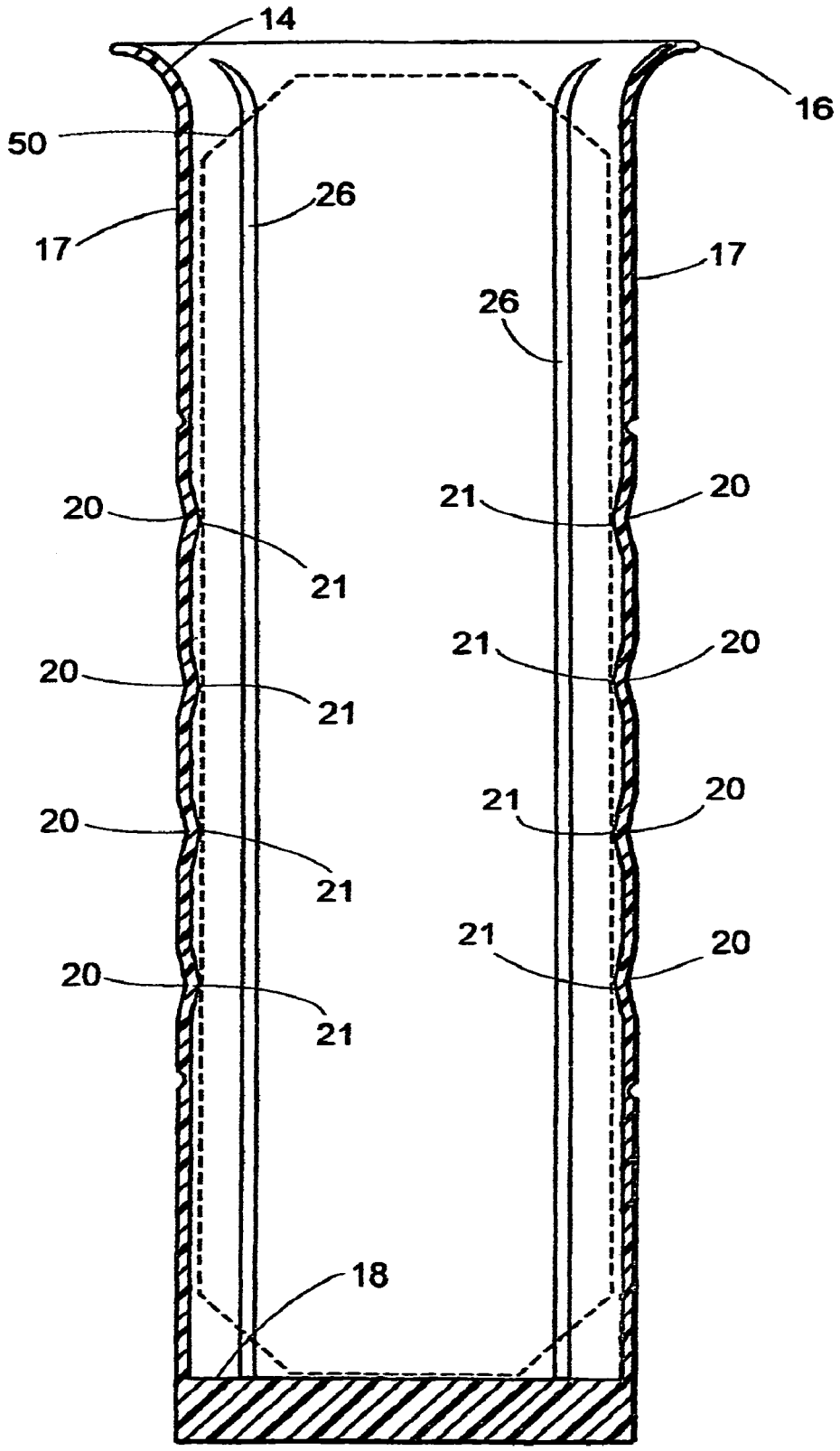
FIG. 5 is an enlarged cross sectional view taken along lines 5-5 of FIG. 4B showing the teeth-like projections of the opposing collapsible wall which when squeezed together, press the teeth-like projections against the sleeve, gripping it; the sleeve being shown in dashed lines and forming no part of the claimed invention.

Means for centering the sleeve 50 in the housing 11 includes a plurality of longitudinal ribs 26, which protrude inwardly from the inner surface of sidewall 17 (FIGS. 2 and 3). The ribs 26 also facilitate the extraction of the sleeve 50 from the roller 51 when the pleated wall section 19 is pressed.

In the preferred embodiment, an identification patch 31 made by sandblasting a portion of the outer surface of the sidewall 17 is provided for the painter's convenience.

So that the open cap 15 can be held out of the way; the strap 23 defines a pair of notches (not shown); and a latch (not shown) is attached to the sidewall 17. When a portion of the strap 23 defining the notches is snap-fitted into the latch, the cap 15 is held against surface 17.

The container 10 measures, by way of example, about 9¾ inches in length and has inner diameters of about 2⅞ inches and 3 7/16 inches proximate with the closed end 12 and rim 16, respectively. A suitable wall thickness for the sidewalls 14, 17 ranges from approximately 0.007 inch to 0.062 inch; and the pleated wall section 19 preferably is about 2 inch wide and 4-112 inches long. The cap-retaining strap 23 is preferably 2-112 closed. The loop so formed can be used to hang the container 10 from a pegboard.

Figure 6:
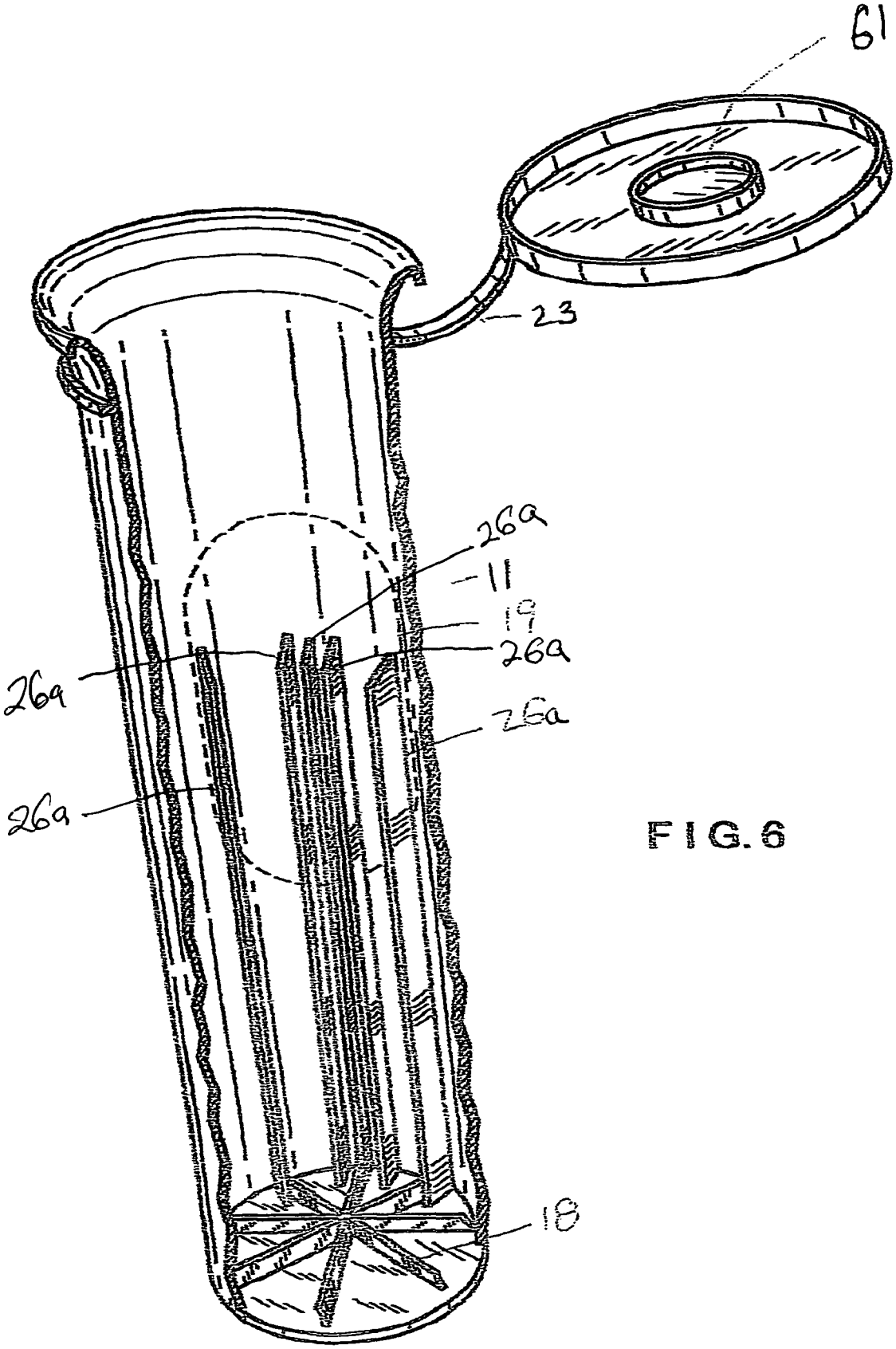
FIG. 6 is a second embodiment of the present invention showing flutes on the opposing collapsible wall which when squeezed together, press the center flute projections against the sleeve, and flexing the two outer flutes on each side of the center flute about the sleeve gripping and centering the sleeve; the sleeve being shown in dashed lines and forming no part of the claimed invention.

Referring now to FIG. 6, FIG. 6 shows a second embodiment of the present invention in which the container again has two pleated sections on the outside or exterior surface areas of the container. A set of flutes **26*a* are located on the interior sides of each area where the pleated sections are located. Each set of flutes 26*a* has a plurality of flutes 26*a* that extend preferably from bottom of the container to approximately 55 percent upward along a longitudinal axis of the container. Each set of flutes 26*a* include preferably three interior flutes and two exterior flutes, each exterior flute being located on opposite sides of the interior three flutes. The interior three flutes include a center flute that is set back a distance from the other two interior flutes that flank the center flute one each side. Preferably the center flute is set back approximately ⅛ of an inch. The top surface of each flute 26*a* has preferably a 45° tapered angle to better facilitate the insertion of a roller cover into the cylinder as the angled edges of the flutes serve to more smoothly guide the roller cover into the cylinder. All five flutes 26*a*** serve on each side of the cylinder serve to stabilize the small diameter roller coves and stop the roller covers from rattling within the cylinder and causing the lid of the container to open and lose its airtight seal.

When pressure is applied on the pleated sections of the cylinder the three center flutes on cylinder bend into the cylinder. The 45 degree angle becomes a sharper angle and cuts into or "bites" into the roller nap, holding the roller cover in place while the roller frame or handle is extracted. The center flute, by being set back ⅛ inch, hits the core of the roller cover at its apex and the other two center flutes spread outward slightly to each side of the roller covert core's center as they come onto contact with the roller cover. The flutes **26*a*** are thus able to hold the roller cover in place while the roller frame is extracted.

In another embodiment a reservoir is provided in the bottom surface of the cylinder for excess paint to be collected therein.

In another embodiment a reservoir having a circular raised shape at the center bottom of the cylinder that matches the circumference of standard sized roller covers, preferably ¼ inch diameter roller covers. The raised circumference prevents excess paint from that drips into an existing reservoir from passing across the center. As a result paint will not be able to rise up into the core of roller cover housed in the container.

While the above describes the preferred embodiment of the invention, it is possible that other embodiments thereof may be made by those skilled in the art that fall within the scope of the following claims.

We claim:

1. A storage container for paint roller cover, comprising:

(a) a flexible, resilient tubular housing for removably storing the cover there within;

(b) the tubular housing including a centrally disposed chamber and a sealed end which defines a reservoir for holding excess paint; distal from the sealed end, the housing terminating in an enlarged funnel-like opening for facilitating insertion of the sleeve into the chamber; and (c) a set of flutes on at least two opposing sides of an interior surface of said cylinder for stabilizing a roller cover in place from rattling inside of said housing and for holding said roller cover in place when extracting a roller frame from said roller cover, each set of flutes includes two exterior flutes and three interior flutes that are located between said two exterior flutes, said exterior and interior flutes being located on an interior surface of the tubular housing, said interior flutes include a middle flute that is set back a distance from said other interior flutes so that when said exterior surface of said container is pressed inward said middle interior flute grips into a paint roller sleeve housed within said container and the other two interior flutes bend outward around a nap of said roller cover to better hold said roller cover in place when a roller frame is being extracted from said roller cover.

2. The roller storage container according to claim 1 wherein said interior middle flute is set back approximately ⅛ inch from said two other interior flutes.

3. The container according to claim 1 wherein said flutes each have an angled top surface to facilitate insertion of a paint sleeve into said container.

4. The container according to claim 3 wherein said angled top surface of each of said flutes is approximately 45°.

5. The container according to claim 1 wherein said container has a bottom interior surface that includes a reservoir for collecting paint dripped from said paint cover.

6. The container according to claim 1 wherein said container includes a bottom surface that includes a reservoir formed as a reservoir having a circularly raised shape at a center of said bottom surface of said cylinder and has a circumference that matches a circumference of standard sized roller covers to prevent excess paint that drips into the reservoir from passing across the center so that paint will not rise up into the core of roller cover housed in the container.

7. The container according to claim 6 wherein said circularly raised reservoir has a ½ inch depth.

8. The container according to claim 1 further comprising a sealing cap removably attachable to the housing proximate with the opening.

9. The container according to claim 1 wherein said middle interior flute grips into said paint roller cover by cutting onto a nap of said paint roller cover.

* * * * *